US006994019B1

(12) United States Patent
Liu et al.

(10) Patent No.: US 6,994,019 B1
(45) Date of Patent: Feb. 7, 2006

(54) EXPAND-AND-CONSTRICT STYLE BAND GUIDING DEVICE FOR A STRAPPING MACHINE

(75) Inventors: Chin-Chang Liu, Taichung (TW); Chi-Jan Su, Taipei (TW)

(73) Assignees: Tepak Corporation, Taichung (TW); Transpak Equipment Corp., Taipei (TW)

( * ) Notice: Subject to any disclaimer, the term of this patent is extended or adjusted under 35 U.S.C. 154(b) by 0 days.

(21) Appl. No.: 10/971,060

(22) Filed: Oct. 25, 2004

(51) Int. Cl.
*B65B 13/04* (2006.01)

(52) U.S. Cl. ..... 100/26; 53/589

(58) Field of Classification Search ..... 100/17, 100/19 R, 25, 26; 53/589, 590
See application file for complete search history.

(56) References Cited

U.S. PATENT DOCUMENTS 3,182,586 A * 5/1965 Armington et al. ..... 100/7
4,106,403 A * 8/1978 Sutehall ..... 100/25
4,254,703 A * 3/1981 Fulton et al. ..... 100/2
6,516,592 B1 * 2/2003 Kimmerle ..... 53/589

* cited by examiner

*Primary Examiner*—Derris H. Banks
*Assistant Examiner*—Jimmy Nguyen
(74) *Attorney, Agent, or Firm*—Troxell Law Office, PLLC

(57) ABSTRACT

An expand-and-constrict type band-guiding device for a strapping machine includes an expand-and-constrict unit, an elastic coiled rod, a receiving member, a roller unit, a motor and a clamp device. The clamp device clamps the end of a strap band, and the motor drives the roller unit for moving the elastic coiled rod to push outward an elongate shift member. Then the strap band with its end pushed to extend by the shift member and then released by the clamp device in due time, with the end of the strap band pushed to the other side from under a storage board for an operator of the strapping machine to catch the strap band.

10 Claims, 9 Drawing Sheets

EXPAND-AND-CONSTRICT STYLE BAND GUIDING DEVICE FOR A STRAPPING MACHINE

BACKGROUND OF THE INVENTION

1. Field of the Invention

This invention relates to a strapping machine, particularly to one usable for strapping various sizes of storage boards, and its strapping operation is simple and fast by means of an expand-and-constrict style band-guiding device for a strapping machine.

2. Description of the Prior Art

In factories, warehouse industries, transportation industries, goods or mechanical components or parts are transported and stored on storage boards by utilizing lift trucks, and during transporting processes, cartons of goods or the like are generally bound on storage boards, as they are liable to sway, loosen, or fall down.

However, conventional strapping machines have a body, a strap band reel, and a band moving device to send the strap band on the reel to a guide rail of a guiding device, and the guide rail is located at the lower portion of the body, normally collapsed vertically onto the body, and swung down to be inserted under a storage boards so as to let the strap band guided by the guide rail to the rear side of the storage board, so a worker to catch the strap band and continue to perform the strapping operation. Some machines have its guide rail fixed immovable and then the strap band is guided by a drive device into the guide rail or extend outward to the rear side of a storage board.

But the conventional strapping machine uses whether a swingable guide rail or an extensible guide rail, and its length is constant, unchangeable and collapsible in the machine body, so its length is limited accordingly. Therefore, when a storage board is longer than the guide rail, the strapping machine cannot be applied. As to the swingable guide rail, when the strapping machine finishes strapping operation once, it has to retreat to let the guide rail completely separate from the storage board so the strapping machine may be turned its direction laterally for another round of operation. Otherwise, the strapping operation is impossible to go on, and it should be very inconvenient, and also requiring a large space for doing so.

SUMMARY OF THE INVENTION

An expand-and-constrict style band guide device for a strapping machine in the invention includes an expand-and-constrict unit, an elastic rod, a receiving member, a roller unit, a motor and a clamp device. The clamp device clamps the end of a strap band in due time, and the end is pushed to extend out by an elongate shift member of the expand-and-constrict unit moved by the elastic coiled rod pushed by the roller unit. Then the clamp device released the band in due time to let the end of the band moved to the other side from under a storage board.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
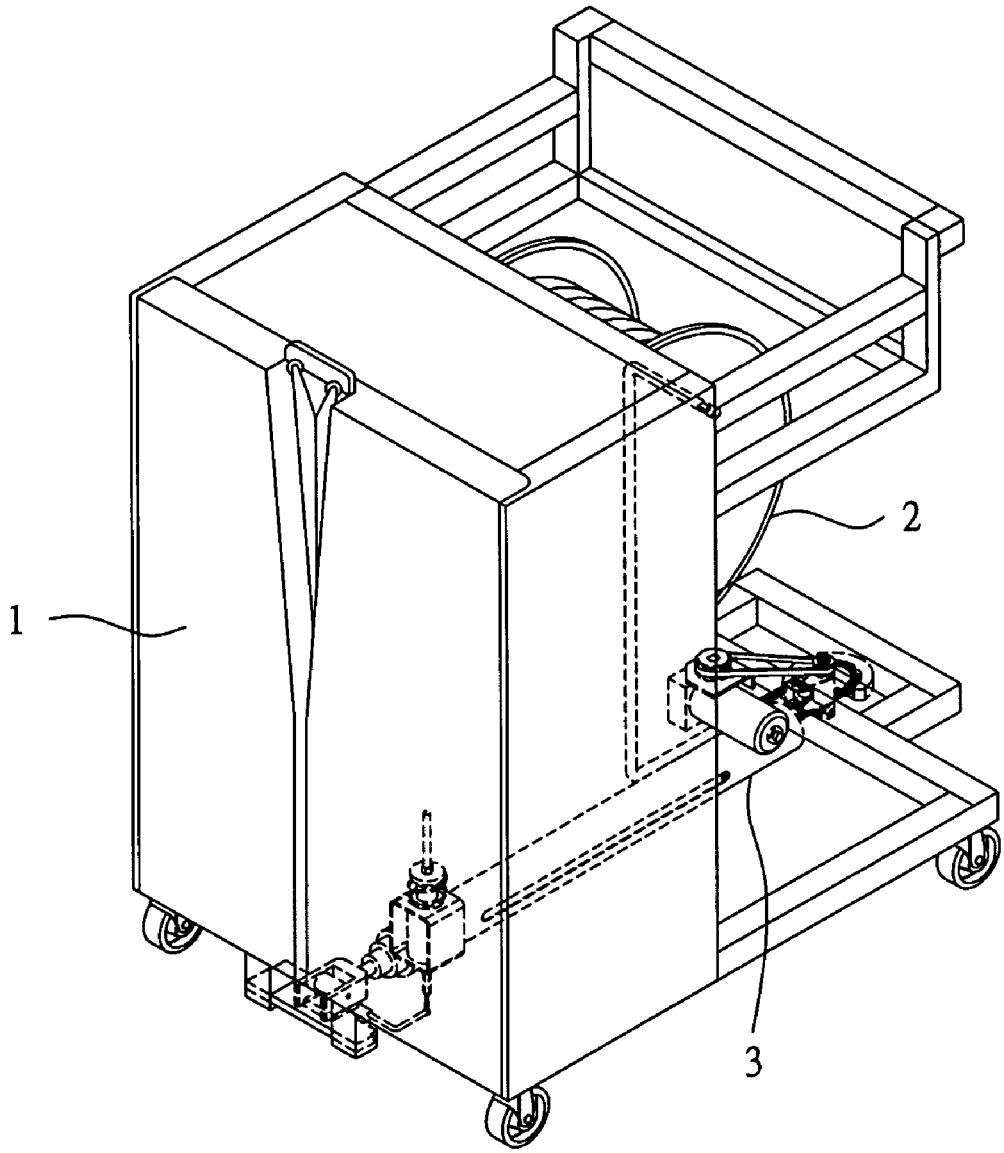
FIG. 1 is a perspective view of a strapping machine provided with an expand-and-constrict style band-guiding device in the present invention.
Figure 2:
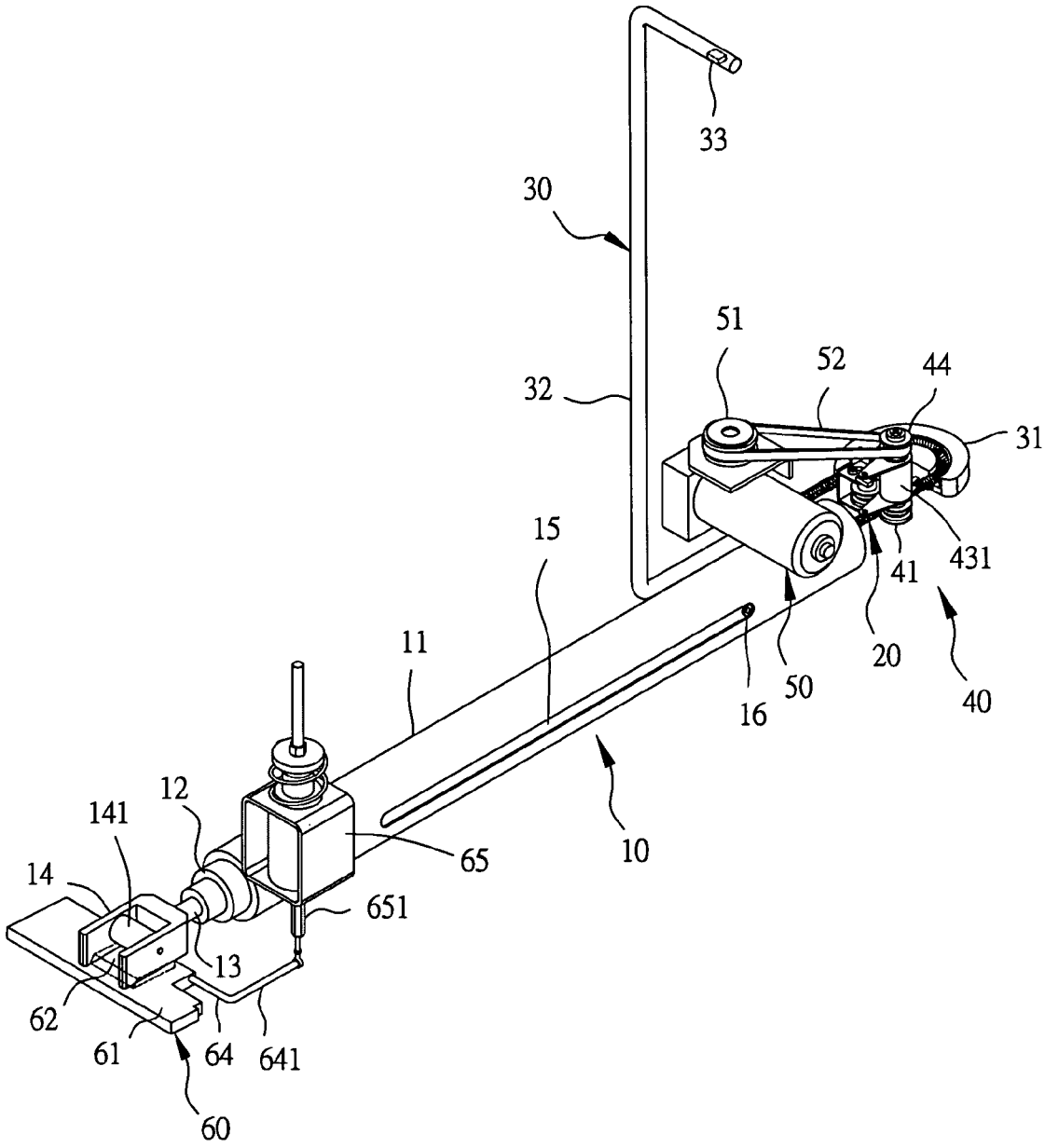
FIG. 2 is a perspective view of a band-guiding device in the present invention.
Figure 3:
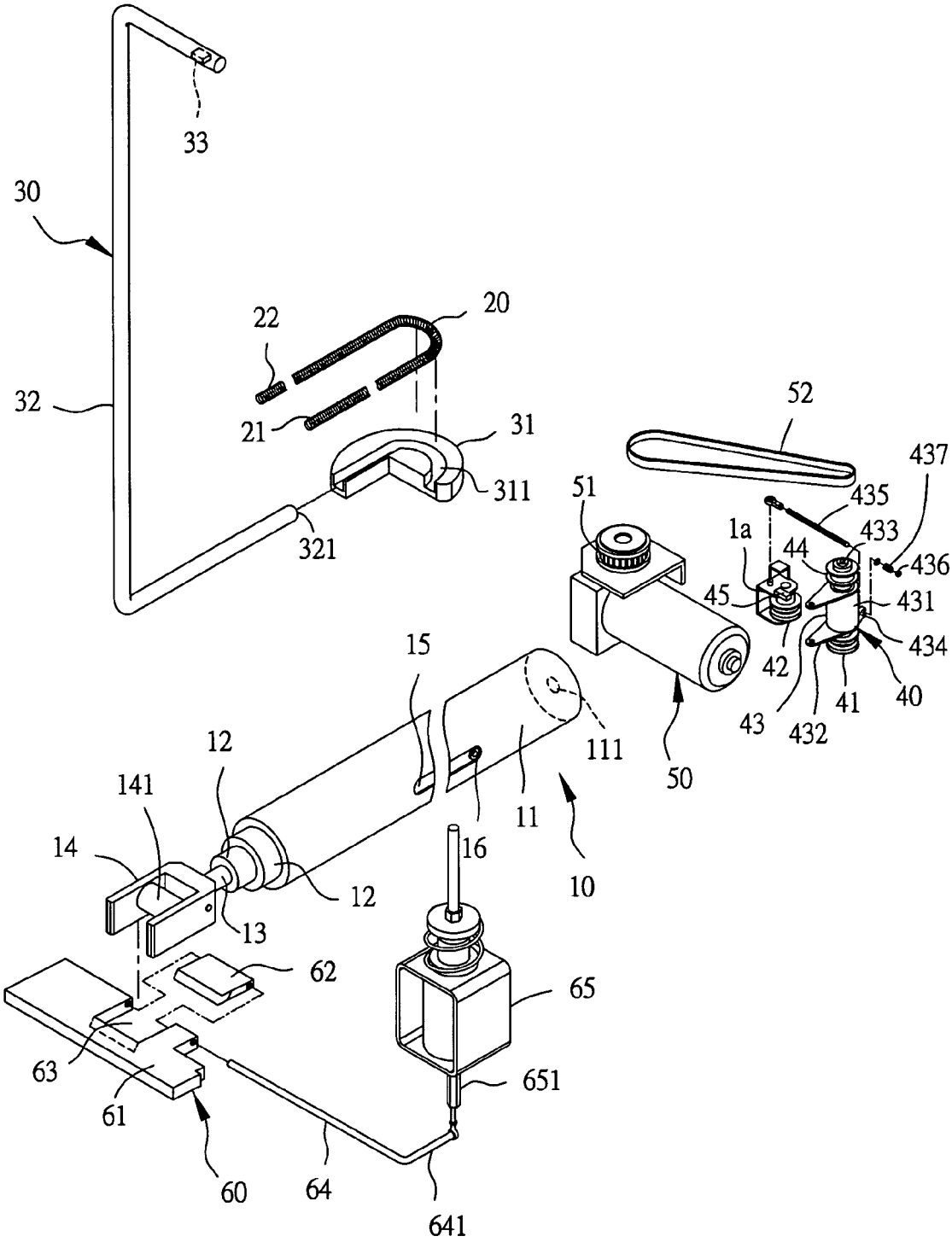
FIG. 3 is an exploded perspective view of the band-guiding device in the present invention.

A preferred embodiment of an expand-and-constrict style band guiding device for a strapping machine in the present invention, as shown in FIGS. 1, 2 and 3, includes a band reel 2, a band moving device (not shown), a band guiding unit 3 combined on a machine body 1.

The band-guiding device 3 consists of an expand-and-constrict unit 10, an elastic coiled rod 20, a receiving member 30, a roller unit 40, a motor 50 and a clamp device 60.

Figure 5:
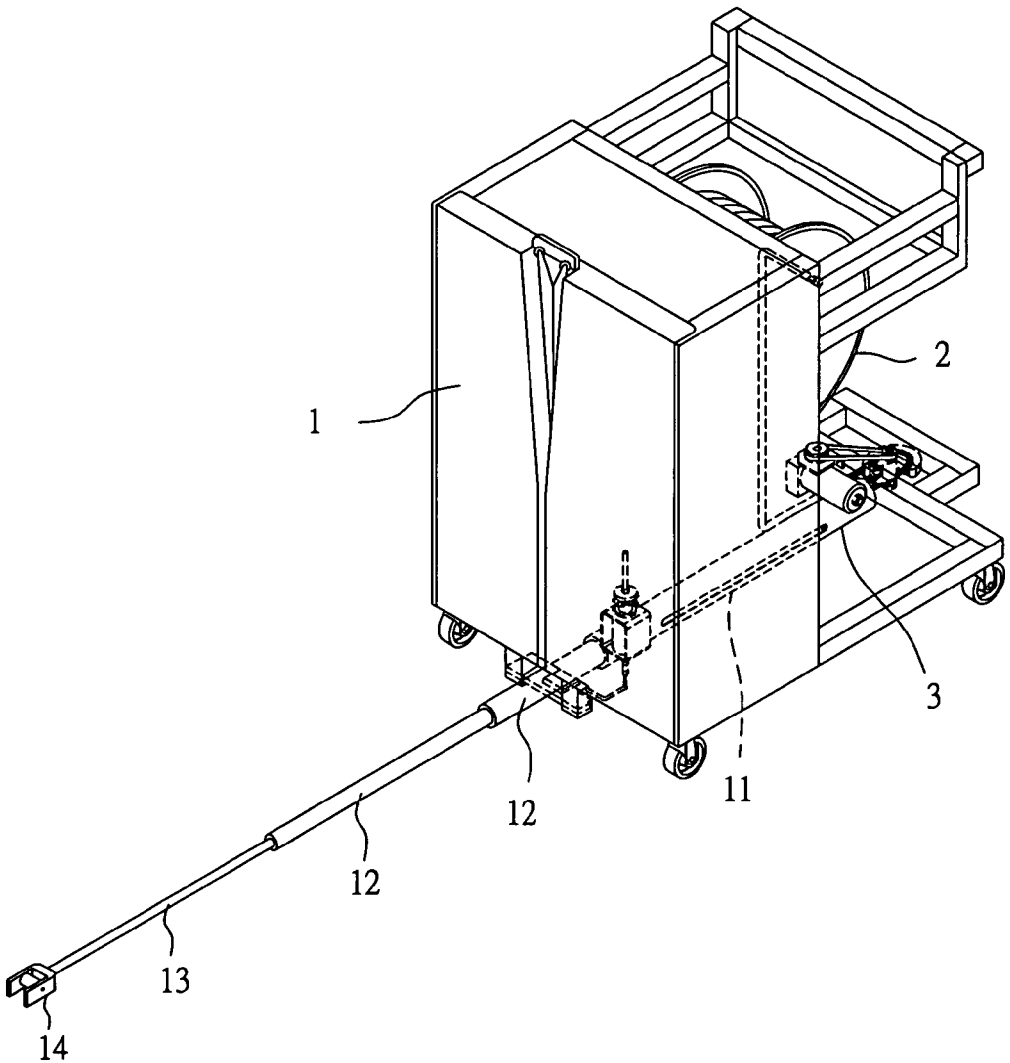
FIG. 5 is a perspective view of a shift member extending out in the present invention.

The expand-and-constrict unit 10, as shown in FIG. 5, consists of an elongate fix member 11, plural elongate slide members 12, an elongate shift member 13, and a U-shaped cylinder base 14 with a cylinder 141. The fix member 11 is tubular, and the slide members 12 are movably fitted in the fix member 11 to telescope in a limited distance, and the second slide member 12 fits with the shift member 13 to telescope with each other, a U-shaped cylinder base 14 is fixed at the end of the shift member 13, and the cylinder 141 is rotatably positioned laterally inside the cylinder base 14, having its outer surface pushing a strap band. Each slide members 12 and the fix member 11 and the shift member 13 are respectively provided with a lengthwise slot 15 for a pin 16 to fit therein to limit the slidable distance of the side members 12 and the shift member 13.

The elastic coiled rod 20 is U-shaped, contained in the expand-and-constrict unit 10, having its first end 21 connected with an inner end of the shift member 13 and its second end 22 protruding out of a center hole 111 of the fix member 11.

The receiving member 30 consists of a double bent tube 32 fixed on a proper location of the machine body 1 and a bent base 31. The bend base 31 is provided with a curved guide groove 311 on its surface, with one end of the curved guide groove 311 facing the center hole 111 of the fix member 11 and with the other end facing the front end of the double bent tube 32 so that the second end 22 of the elastic coiled rod 20 protruding out of the center hole 111 may extend in the curved guide groove 311 of the bent base 31, then through the front end 321 of the tube 32 in the deeper portion of the tube 32. Further, a sensor 33 is fixed on the rear end of the double bent tube 32 for sensing and controlling the expand-and-constrict unit 10 to retreat back to the original position when the elastic rod 20 moves near the sensor 33.

Figure 4:
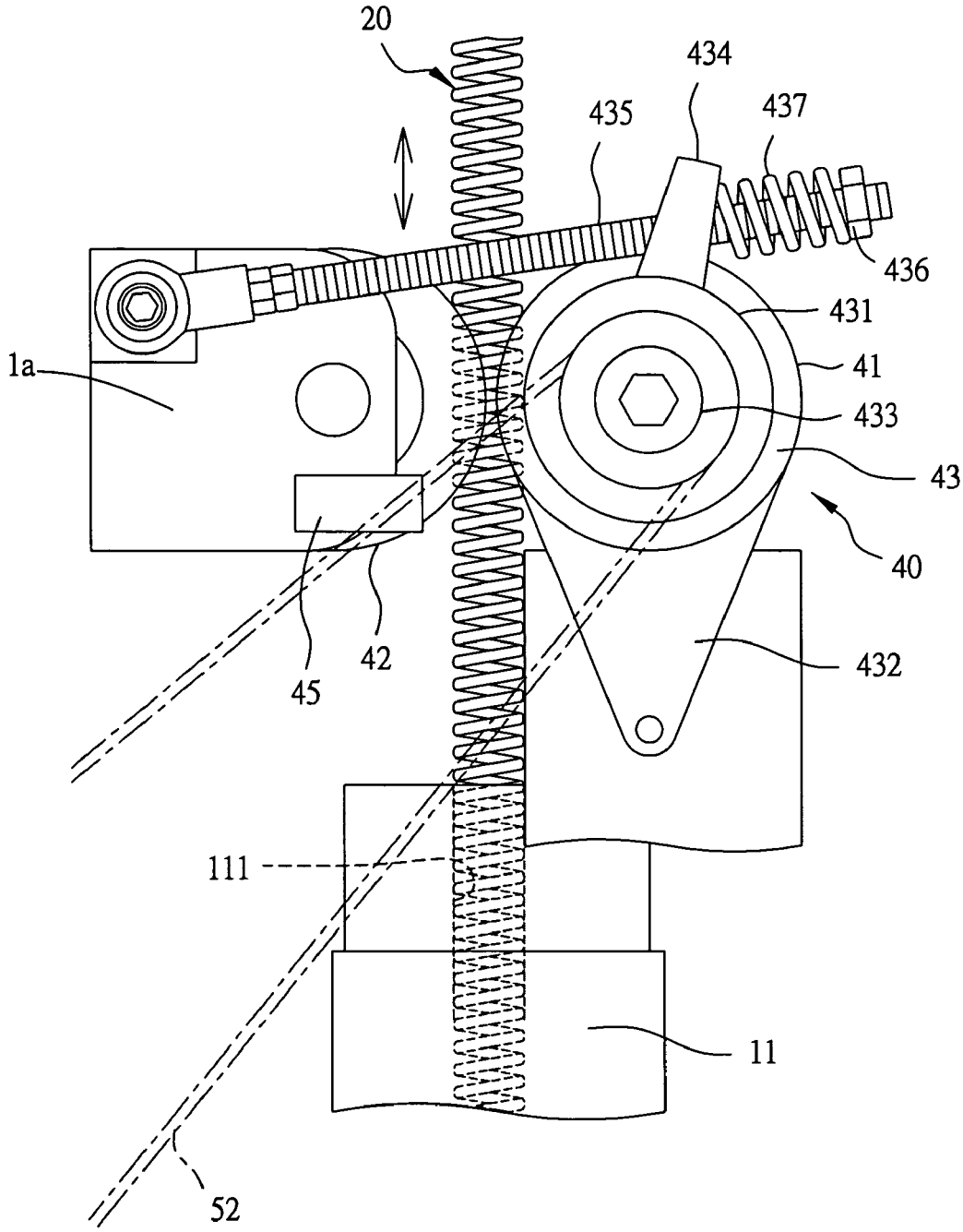
FIG. 4 is an upper side view of a roller unit and an elastic coiled rod in the present invention.

The roller unit 40, as shown in FIG. 4, is composed of a first roller 41 and a second roller 42 facing each other, respectively located at two sides of the elastic coiled rod 20 located between the bend base 31 and the tube 32. Then the elastic coiled rod 20 can be sandwiched and moved by the two rollers 41 and 42 to a preset direction. The first roller 41 is fixed with two pivotal plates 1 a provided on the strap machine 1 with shafts, and a sensor 45 is provided on the pivotal plate 1*a,* and the second roller 42 matches with a roller base 43 provided with a tubular shaft 431 and a connect arm 432 extending out of the annular surface of the tubular shaft 431. The connect arm 432 is fixed on a proper location of the machine body 1 with a shaft, and a rotatable shaft 433 is fitted around a center shaft fitting in the tubular shaft 43, having its lower end combined with the second roller 42 with a shaft, and its upper end fixed with an input belt wheel 44. Further, the tubular shaft 431 has a projecting ear 434 on its annular surface, and a connect rod 435 is provided to pass through a hole of the projecting ear 434, which has its one end fixed with a proper location of the machine body 1 and its other end screwing with an adjust nut 436 to secure a spring 437 around the connect rod 435 for elastically pressing the projecting ear 434 and at the same time forcing the second roller 42 elastically pressing on the elastic coiled rod 20, with the adjust nut 435 adjusting the compressing force.

The motor 50 is fixed on a proper location of the machine body 1, driving an output belt wheel 51 by a belt 52 for moving the input belt wheel 44 of the roller unit 40.

The clamp device 60 is fixed properly on the bottom of the machine body 1, having a base plate 61 under the end of the shift member 13 of the expand-and-constrict unit 10 and a clamp block 62 pivotally connected to the base plate 61. Then a clamp aperture 63 is formed in the intermediate portion of the base plate 61, and the clamp block 62 can be swung into the clamp aperture, pivotally connected with the base plate 61 with an elongate pivot 64, which has a bent end 641 combined movably with the end of a valve rod 651 of an electro-magnetic valve 65. Then the pivot 64 is moved up and down by the valve rod 65 for the clamp block 62 to swing to produce clamping or loosening function against the strap band with cooperation of the base plate 61.

Figure 6:
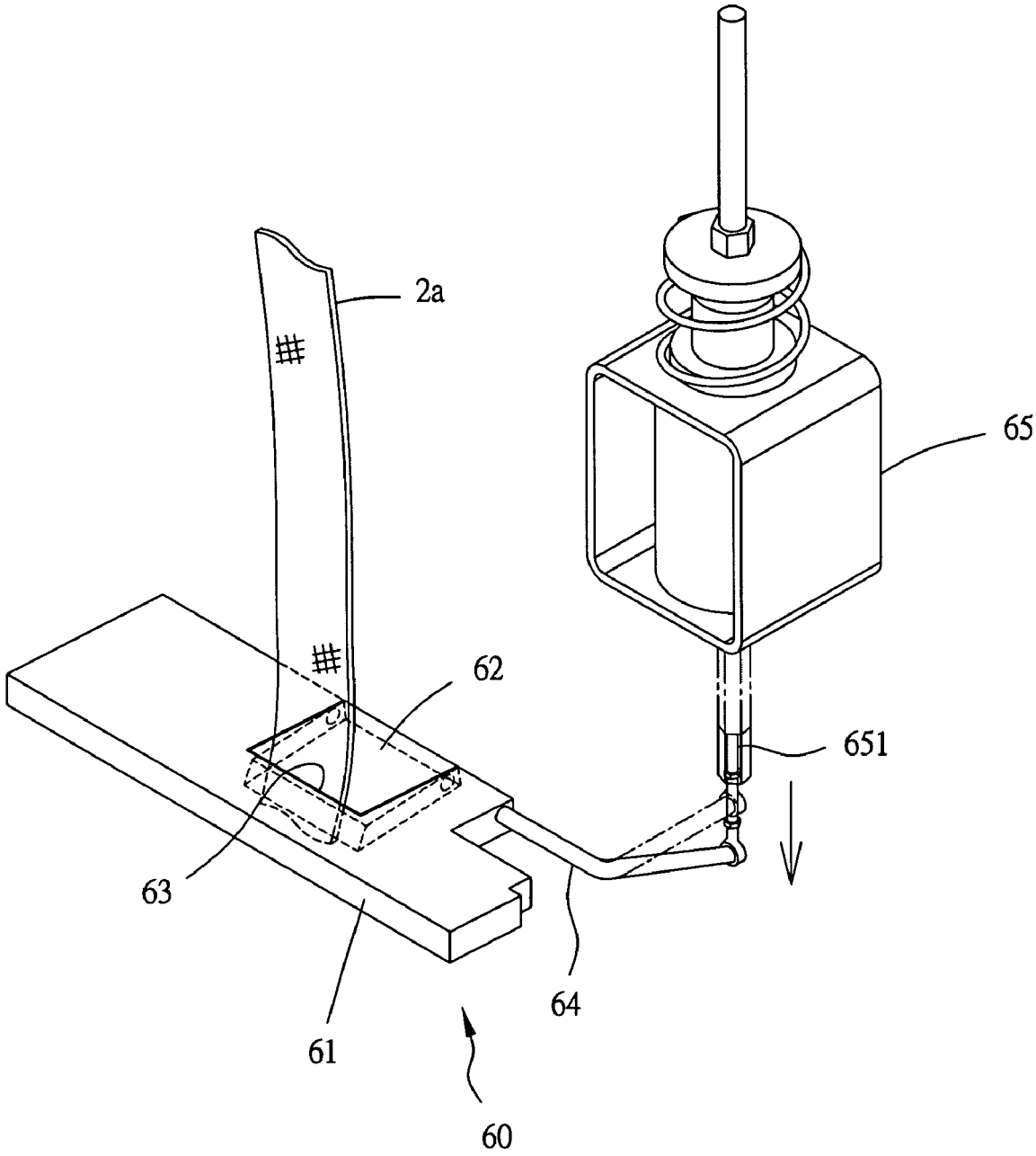
FIG. 6 is a perspective view of a clamp device clamping a band in the present invention.
Figure 7:
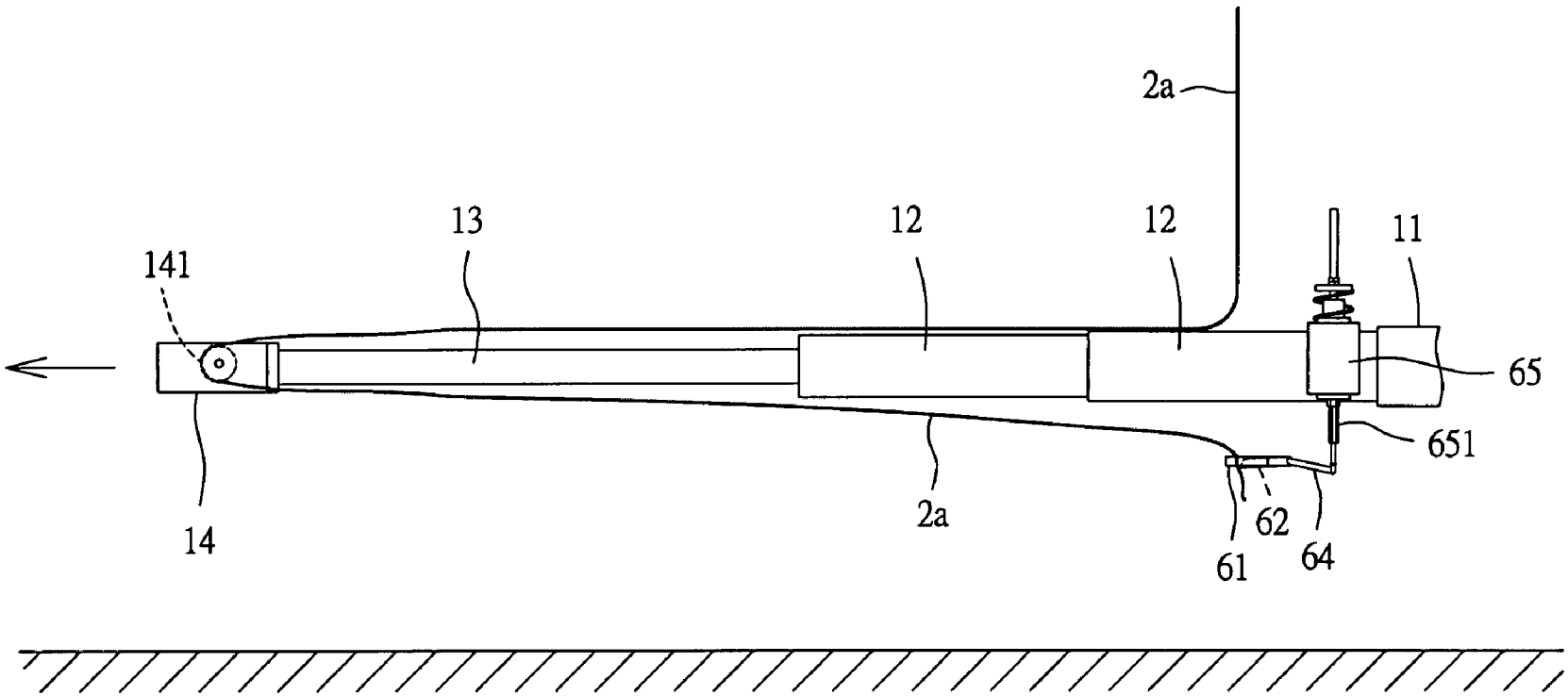
FIG. 7 is a side view of the expand-and-constrict unit being extended out with the band clamped in the present invention.
Figure 8:
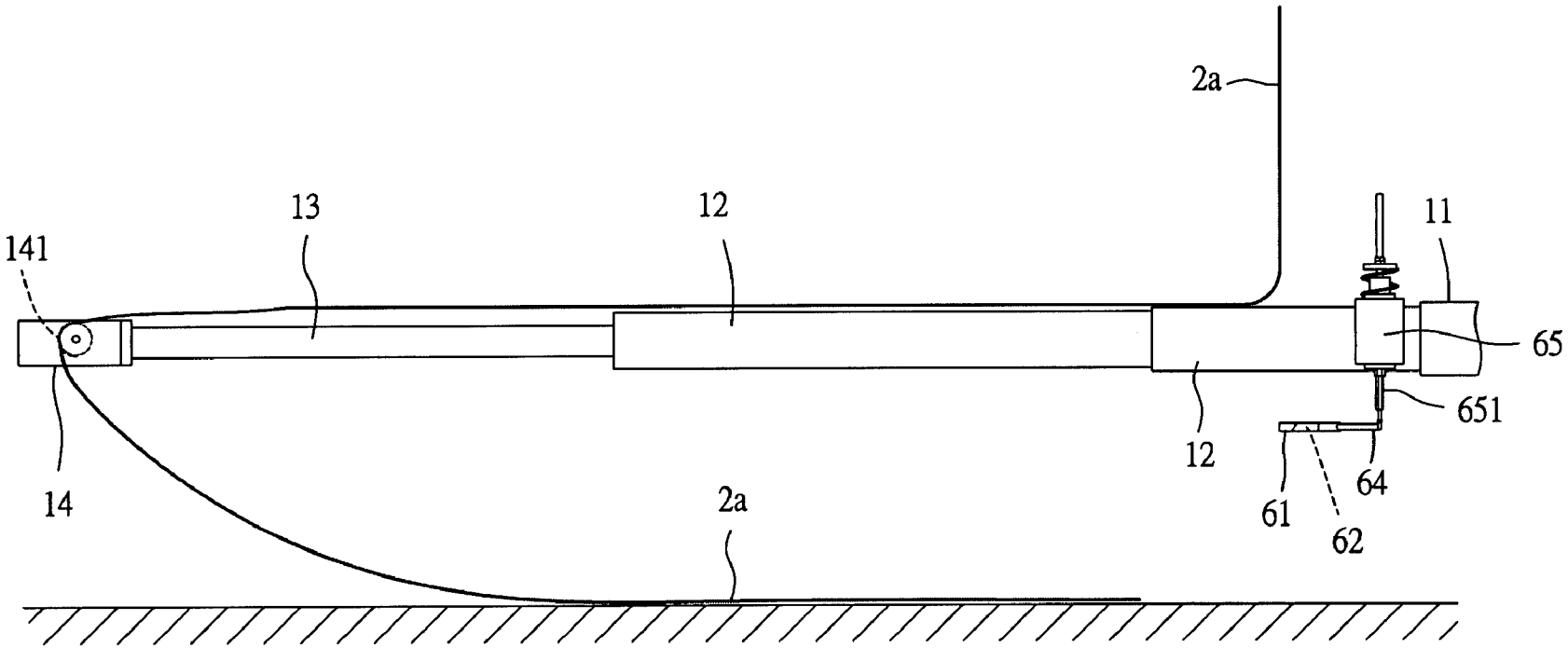
FIG. 8 is a side view of the expand-and-constrict unit being extended out with the band in a released condition in the present invention; and, FIG. 9 is a perspective view of the expand-and-constrict device extending out on a storage board in the present invention.
Figure 9:
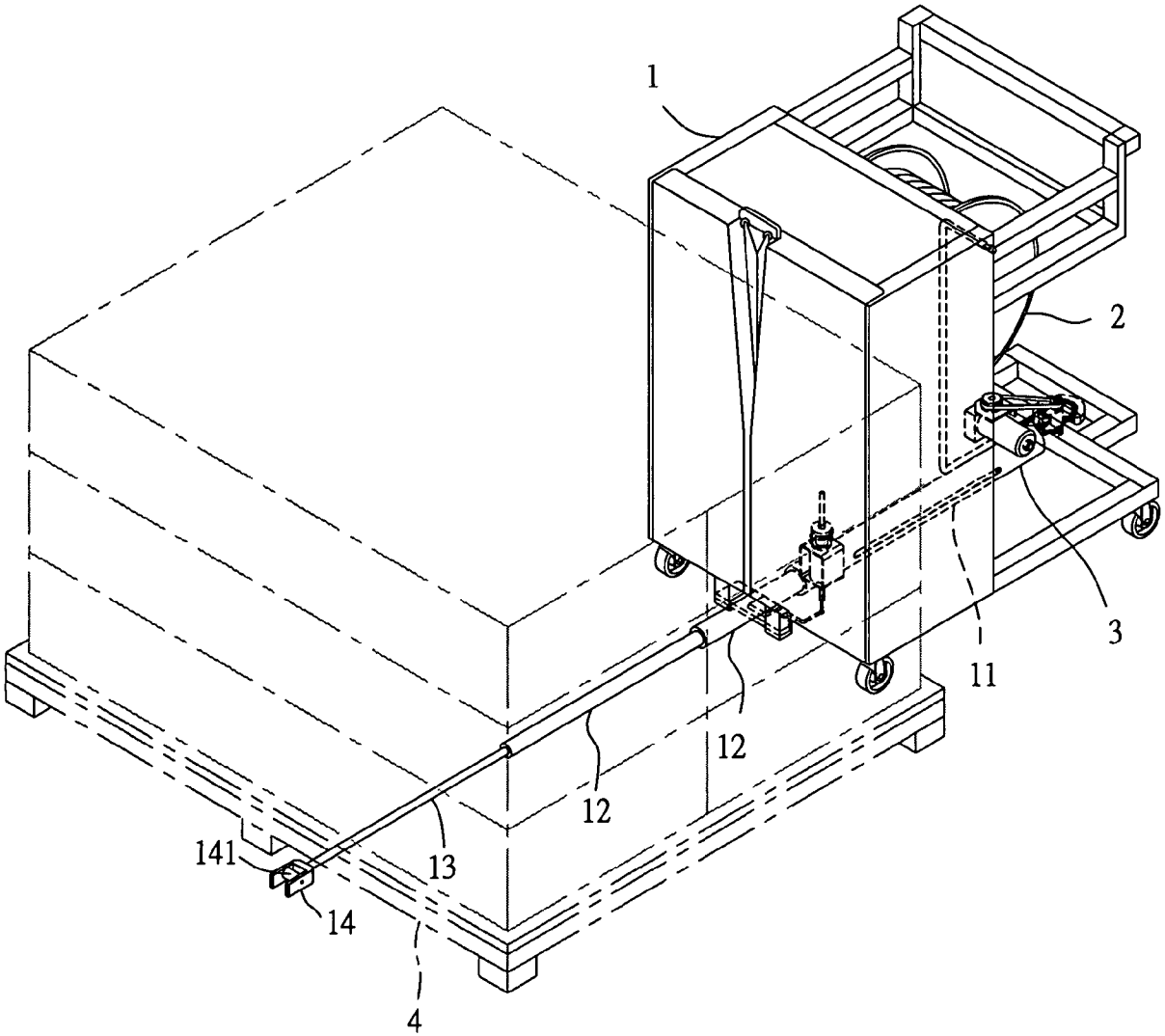

In operating the strapping machine, referring to FIGS. 1 and 9, firstly a user moves the strapping machine near to a storage board 4, and aligns the expand-and-constrict unit 10 to the storage plate to be strapped, and then starts the band moving device, letting the strap band 2*a* conveyed into the clamp groove 63 of the clamp device 60, as shown in FIG. 6. Then the user starts the electro-magnetic valve 65 to let the valve rod 651 swing the clamp block 62 properly for clamping the end of the strap band 2*a* moving in the clamp groove 63 between the clamp block 62 and the base plate 61. Then the motor 5 is started to directly move the first roller 41 of the roller unit 40, as shown in FIGS. 2 and 4, pushing the elastic coiled rod 20 sandwiched between the two rollers 41 and 42 toward the expand-an-constrict unit 10. Then the shift member 13 connected with the end of the elastic coiled rod 20 may be moved to extend out, with the cylinder 141 at its end moving nearer to the strap band 2*a* with its end clamped immovable and forming a U shape by extending orderly into the rear portion of the storage plate 4, as shown in FIG. 7. After the strap band 2*a* is pushed to nearly more than half of the width of the storage plate 4, the electro-magnetic valve 65 controlled by a timer operates to let the valve rod 651 swing the clamp block 62 to loosen the strap band 2*a*. Then the lower half of the U-shaped strap band 2*a* can be continually pushed to the other side of he storage plate 4, as shown in FIGS. 8 and 9, and the sensor 45 on the pivotal plate 1*a* detects the rotate rounds of the second roller 42 and controls to extend out the shift member 13 for a needed length according to the width of the storage board 4, finishing guiding the band. Then the worker can easily catch hold of the band 2*a* and proceeds to subsequent strapping work. Here it has to be noticed that after the band 2*a* is pushed to the other side of the storage plate 4, the motor has to be started to drive the roller unit 40 to retreat the elastic coiled rod 20 back to the receiving member 30, and orderly retreat the slide members 12 back. Thus the strapping machine can directly be turned laterally for next round of work.

Next, the invention has the following advantages, as can be understood from the foresaid description.

1. The expand-and-constrict unit 10 has a wide range of extending and shrinking by means of the elastic coiled rod 20, possible to improve the drawback of the conventional strapping machine and applicable to various storage boards of different sizes .

2. The expand-and-constrict unit 10 can retreat back automatically after finishing one round of pushing out the strap band, retreating completely in the strapping machine, so the strapping machine does not need to move back and immediately be turned laterally to carry out next round of work, facilitating work and shorten the time used for strapping. Besides, the space for work can be saved.

3. The shift member 1 is moved by the elastic coiled rod 20, which is moved by the two rollers 41 and 42, so in extending or retreating, if the shift member 13 collides with something and meets resistance, the resistance is transmitted to the sandwiched locations of the elastic coiled rod 10 and the two rollers 41 and 42. But when the resistance is larger than a certain extent, the elastic coiled rod 20 may slip ageist the two rollers 41 and 42, and then the motor 50 may automatically stop within a few seconds. So the shift member 13 may not be forced to extend out so that the expand-and-constrict unit 10 may be protected, not be damaged. In addition, should the shift member 13 contact a worker, there might be no danger.

While the preferred embodiment of the invention has been described above, it will be recognized and understood that various modifications may be made therein and the appended claims are intended to cover all such modifications that may fall within the spirit and scope of the invention.

What is claimed is:

1. An expand-and-constrict type band guiding device for a strapping machine, said band guiding device comprising:

An expand-and-constrict unit having an elongate fix member fixed on a bottom of a strapping machine and plural elongate slide members fitted in said fix member to telescope each other, and an elongate shift member telescopically fitted in one of said elongate slide members;

An elastic coiled rod positioned properly on said expand-and-constrict unit and shaped as U, having a first end connected to an inner end of said shift member and a second end;

A receiving member fixed on a proper location of said strapping machine, said second end of said elastic coiled rod extended into said receiving member, A roller unit having two rollers facing each other, said two rollers fixed with shafts on said strapping machine at two sides of said elastic coiled rod, said two rollers sandwiched said elastic coiled rod and move it in a preset direction so that said shift member may be extend outward or retreat inward;

A clamp device fixed on a proper location of the bottom of said strapping machine for clamping the end of a strap band passing over a pushing location of said expand-and-constrict unit, said shift member pushing said strap band out for a preset distance, said clamp device releasing said band in due time so that the end of said band may be continually pushed to another side of a storage board for an operator of said strapping machine to conveniently catch hold of the band for subsequent work.

2. The band-guiding device for a strapping machine as claimed in claim 1, wherein said fix member, said slide members and said shift member are fitted in one another and possible to telescope to one another within a limited distance.

3. The band guiding device for a strapping machine as claimed in claim 2, wherein said fix member and said slide members respectively are provided with a lengthwise slot to match with one another for a pin to fit in so as to limit the distance of extending outward and retreating inward of said slide members.

4. The band guiding device for a strapping machine as claimed in claim 1, wherein a U-shaped cylinder base is connected to the outer end of said shift member, and a cylinder is rotatably provided in said cylinder base so said cylinder has its outer surface possible to push said strap band.

5. The band guiding device for a strapping machine as claimed in claim 1, wherein said receiving member has a bent base and a double bent elongate tube, said bent base has a curved guide groove on its surface, said curved guide groove has its one end facing the point where said elastic coiled rod extends in said fix member and the other end facing an end of said double bent tube.

6. The band guiding device for a strapping machine as claimed in claim 5, wherein said double bent tube is provided with a sensor at its other end, and said sensor can sense the end of said elastic coiled rod when said elastic coiled rod is retreating, and automatically stops the retreating action of said expand-and-constrict unit.

7. The band guiding device for a strapping machine as claimed in claim 1, wherein one roller of said roller unit can be adjusted to move nearer to the other roller for elastically pressing said elastic coiled rod.

8. The band-guiding device for a strapping machine as claimed in claim 1, wherein one of said two rollers of said roller unit is driven by a motor.

9. The band guiding device for a strapping machine as claimed in claim 1, wherein said clamp device consists of a base plate fixed on a proper location of the bottom of said strapping machine and a clamp block pivotally connected to said base plate, and a clamp gap is formed between said clamp block and said base plate so that said strap band may pass through said clamp gap.

10. The band guiding device for a strapping machine as claimed in claim 9, wherein an electro-magnetic valve is further provided, having a valve rod moving back and forth to swing up and down said pivot of said clamp block for sandwiching tightly or releasing said strap band.

* * * * *